United States Patent [19]

Wu

[11] Patent Number: 4,976,581

[45] Date of Patent: Dec. 11, 1990

[54] MULTI-STORIED PARKING APPARATUS

[76] Inventor: Shun C. Wu, 13F, No. 501, Tunhua South Road., Taipei, Taiwan

[21] Appl. No.: 265,902

[22] Filed: Nov. 2, 1988

[51] Int. Cl.[5] ..... E04H 6/00

[52] U.S. Cl. ..... 414/257; 414/786; 414/252; 414/253; 414/262; 414/264; 414/259

[58] Field of Search ..... 414/264, 261, 262, 259, 414/257, 253, 231, 232, 227, 241, 278, 285, 252, 786

[56] References Cited

U.S. PATENT DOCUMENTS

| | | | |
|---|---|---|---|
| 1,969,002 | 8/1934 | Gleichman | 414/257 |
| 2,899,086 | 8/1959 | de Saint-André414 | 257 X/ |
| 2,899,087 | 8/1959 | Jacobsen | 414/253 X |
| 3,217,905 | 11/1965 | Frangos | 414/262 X |
| 4,664,580 | 5/1987 | Matoba | 414/264 X |

FOREIGN PATENT DOCUMENTS

| | | | |
|---|---|---|---|
| 229880 | 1/1960 | Australia | 414/264 |
| 112477 | 12/1968 | Denmark | 414/253 |
| 1279922 | 10/1968 | Fed. Rep. of Germany | 414/259 |
| 85914 | 5/1955 | Norway | 414/264 |
| 435672 | 10/1967 | Switzerland | 414/259 |

*Primary Examiner*—Frank E. Werner

*Attorney, Agent, or Firm*—Cushman, Darby & Cushman

[57] ABSTRACT

A parking apparatus includes a multi-storied building having at least one parking position on each of its stories, and a transporting device having a central portion and four primary sides each of which is capable of adjoining thereto the parking position, and is capable of vertically moving a car to any one of the stories of the building and of conveying the car between the central portion and the parking position.

9 Claims, 10 Drawing Sheets

301a'
301a
301a'
301a
301a'
301b
301b
312
313
301c
301c'
301d
311

312
313
C
C
301b
301c'
301c
311
301c'
301b 104
105
103
102
101

105
102
104
101

103

105
102

104
105
103

101

101
105
103

101

103

105
104

102

104

105
102

104
102

MULTI-STORIED PARKING APPARATUS

BACKGROUND OF THE INVENTION

The present invention relates to a parking apparatus, and more particularly to a multi-storied parking apparatus.

As the number of cars rapidly increases, it is more and more difficult to find a parking place in urban areas during office hours. To this day, to the knowledge of the Applicant, the most advanced prior art with respect to the parking apparatus is a multi-storied building made of two opposite halves, each composed of numerous parking divisions with the space between the halves mounted with a car-carrying means capable of reaching any parking division at any story of the building. Although such parking apparatus solves some problems encountered by prior apparatus, it still has the following disadvantages:

(1) the middle longitudinal space mounting the car-carrying means is relatively large and wastes space;

(2) the whole car-carrying means structure itself is extremely large;

(3) the time used for the car-carrying means to park or retrieve a car is rather long;

(4) because of its large size, the car-carrying means is very power consuming;

It has been therefore attempted by the Applicant to deal with the above-mentioned problems.

SUMMARY OF THE INVENTION

It is one of the objects of the present invention to provide a multi-storied parking apparatus capable of fully using the available space to the largest extent.

A further objective of the present invention, is to provide a multi-storied parking apparatus suitable for construction on any possible location.

An additional object of the present invention, is to provide a multi-storied parking apparatus capable of both parking a car and retrieving it from its parking position in a short amount of time.

According to the present invention, the parking apparatus includes a multi-storied building having at least one parking position on each of its stories a transporting means having a central portion and four primary sides each of which is capable of adjoining thereto the parking position, the transporting means likewise being capable of vertically moving a car to any one of the stories, and also capable of conveying the car between the central portion and the parking position.

BRIEF DESCRIPTION OF THE DRAWING

The present invention may best be understood through the following description with reference to the accompanying drawings, in which:

FIGS. 2, 2A and 2B are sectional views taken along line D—D shown in FIG. 1;

FIGS. 11A through 110 are schematic views showing all possible combinations of a parking unit in the multi-storied parking apparatus shown in FIG. 1.

DETAILED DESCRIPTION OF THE PREFERRED EMBODIMENT

Figure 1:
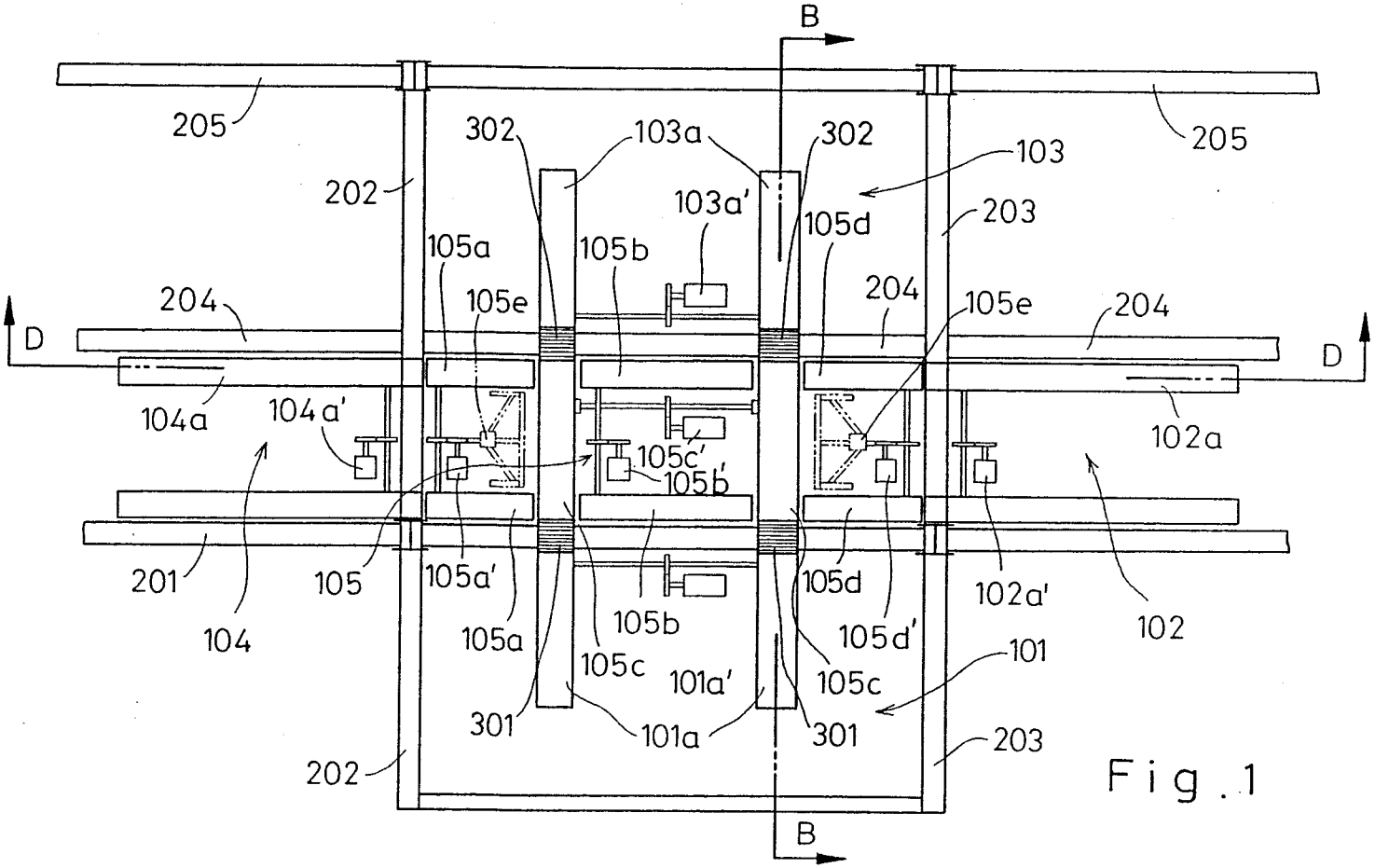
FIG. 1 is a schematic view showing an integral parking unit of a multi-storied parking apparatus according to the present invention.
Figures 2A, 2B:
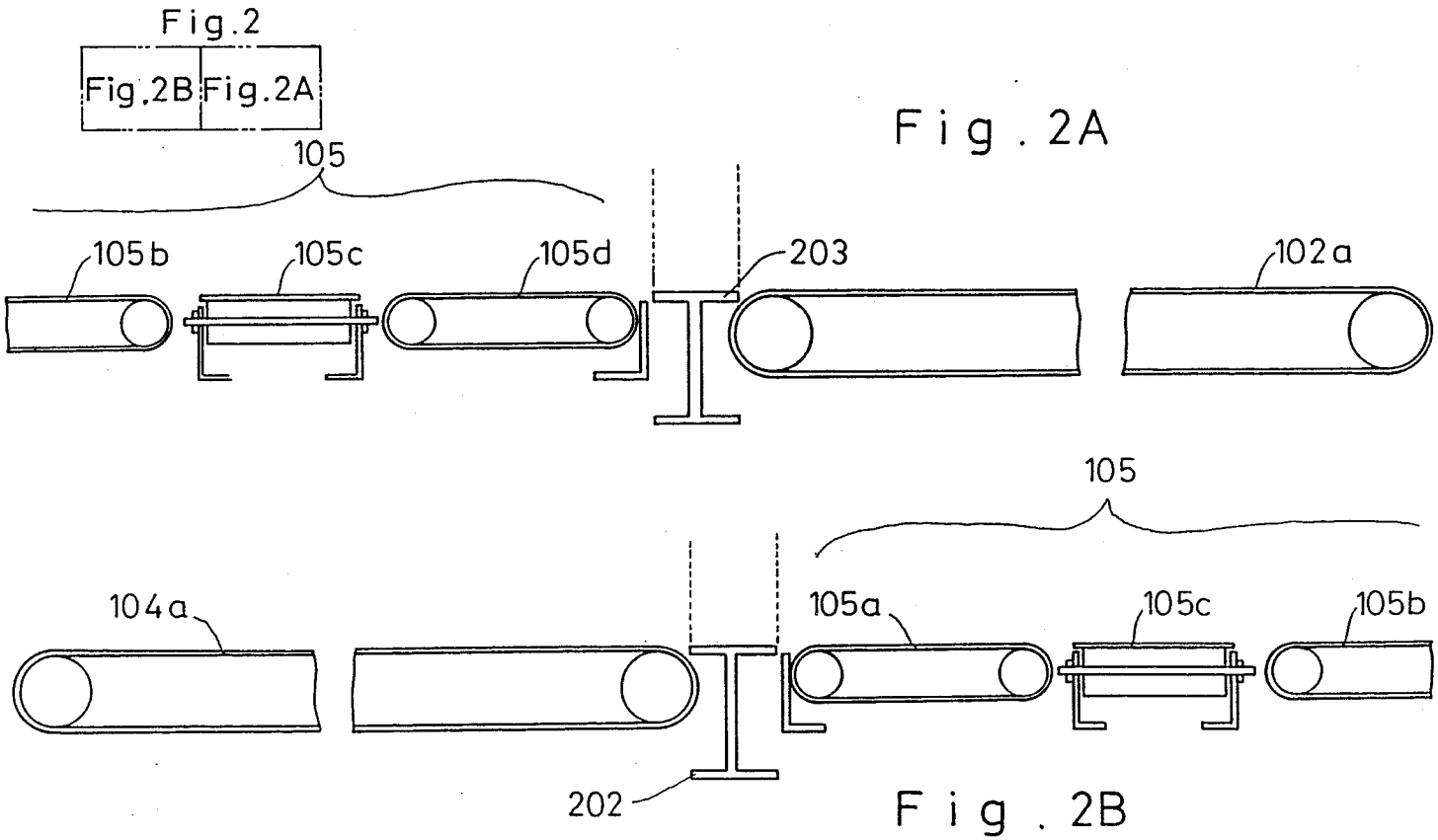
Figure 3:
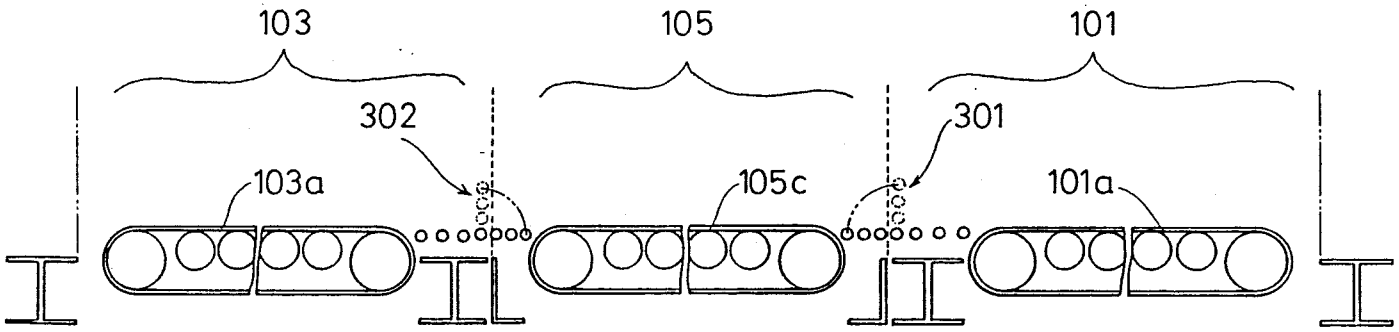
FIG. 3 is a sectional view taken along line B—B shown in FIG. 1.
Figure 10:
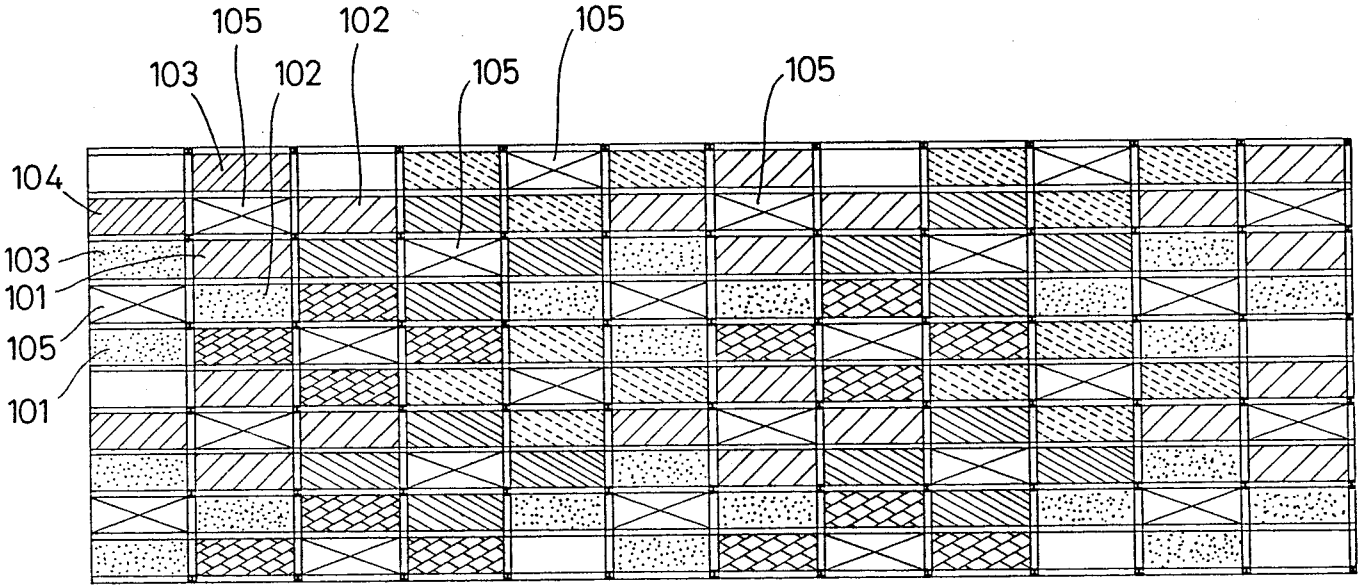
FIG. 10 is a schematic view showing the disposition of parking units in a story in the multi-storied parking apparatus shown in FIG. 1.
Figures 11A, 11B, 11C, 11D, 11E, 11F, 11G, 11H, 11I, 11J, 11K, 11L, 11M, 11N, 11O:
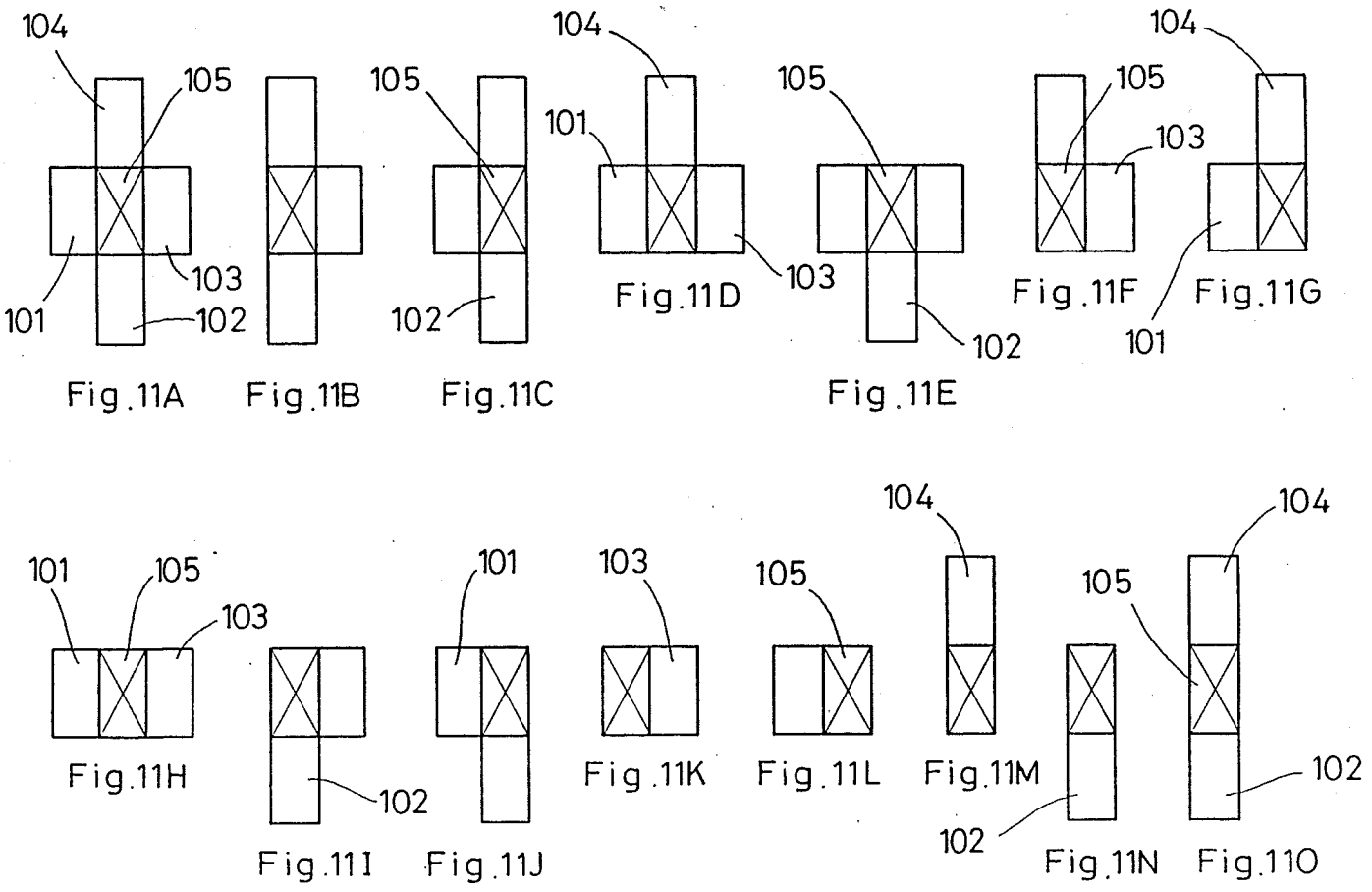
Figure 12:
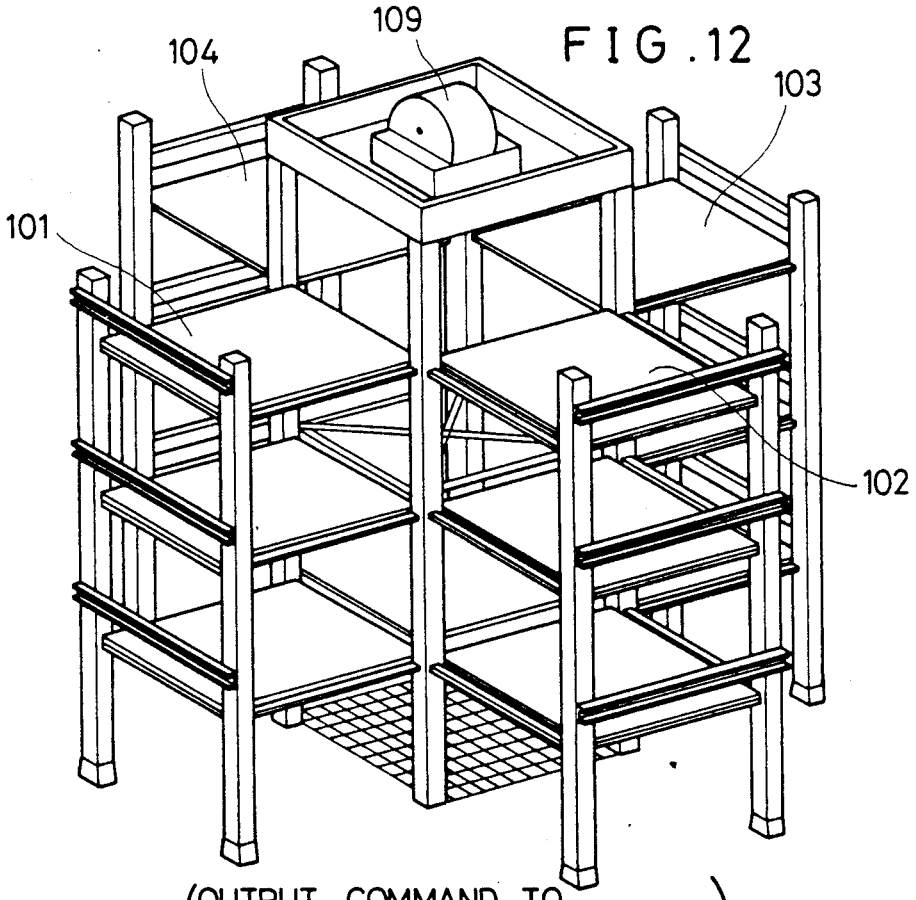
FIG. 12 is a perspective view of the multi-lateral parking garage of the present invention showing the vertical conveying means and its motor drive.
Figure 13:
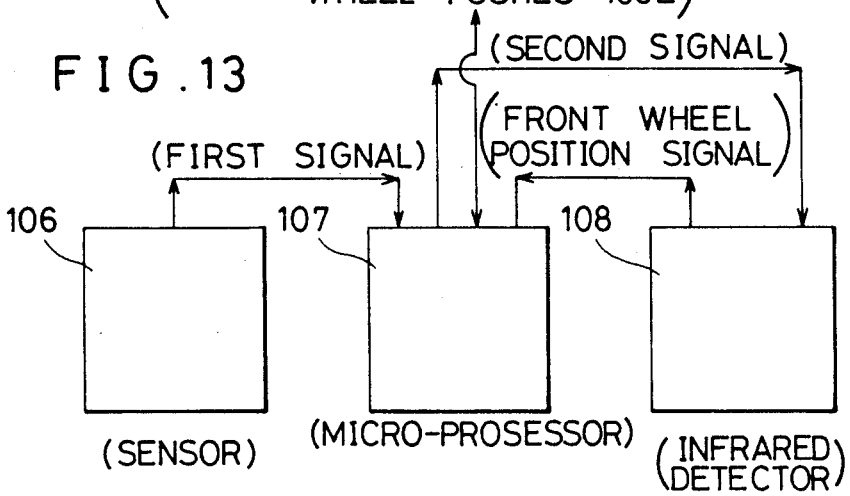
FIG. 13 is a block diagram of the wheel-pushers control system.

As shown in FIGS. 1, 10 and 11A, an integral parking unit of the multi-storied parking apparatus according to the present invention includes four coplanar side parking positions 101, 102, 103 and 104 in the multi-storied building and a central transporting means 105 capable of being commonly used for all parking positions in each story of the building adjoining four primary sides of transporting means 105 when elevated to the respective story. FIGS. 11B through 110 show all possible combinations between transporting means 105 and parking positions 101–104 when the parking space is spatially limited somehow or other. As shown in FIG. 10, a regular disposition of the parking positions and the transporting means in each story of the multi-storied building of the parking apparatus according to the present invention includes a relatively large number of integral parking units as shown in FIG. 11A and a relatively small number of partial parking units as shown in some of FIGS. 11B through 110.

Refering now to FIGS. 1–7, each portion (101–105) of the integral parking unit is constructed by the floor 200 and the structural steel beams 201–204. The parking positions 101–104 are respectively provided with four pairs of synchronous conveying belts **101*a*–104*a* respectively driven by four driving assemblies 101*a*'–104*a*' respectively mounted on the respective floor 200. Transporting means 105 defining therein a central portion includes four pairs of conveying belts 105*a*–105*d* being respectively flush with the respective conveying belts 101*a*–104*a* and respectively driven by the driving assemblies 105*a*'–105*d*' mounted on the floor 200 of the transporting means 105. The driving assemblies 101*a*'–104*a*' and 105*a*'–105*d*' respectively synchronously drive the pairs of the conveying belts 101*a*–104*a* and 105*a*–105*d*** by motors.

Figures 7, 7A:
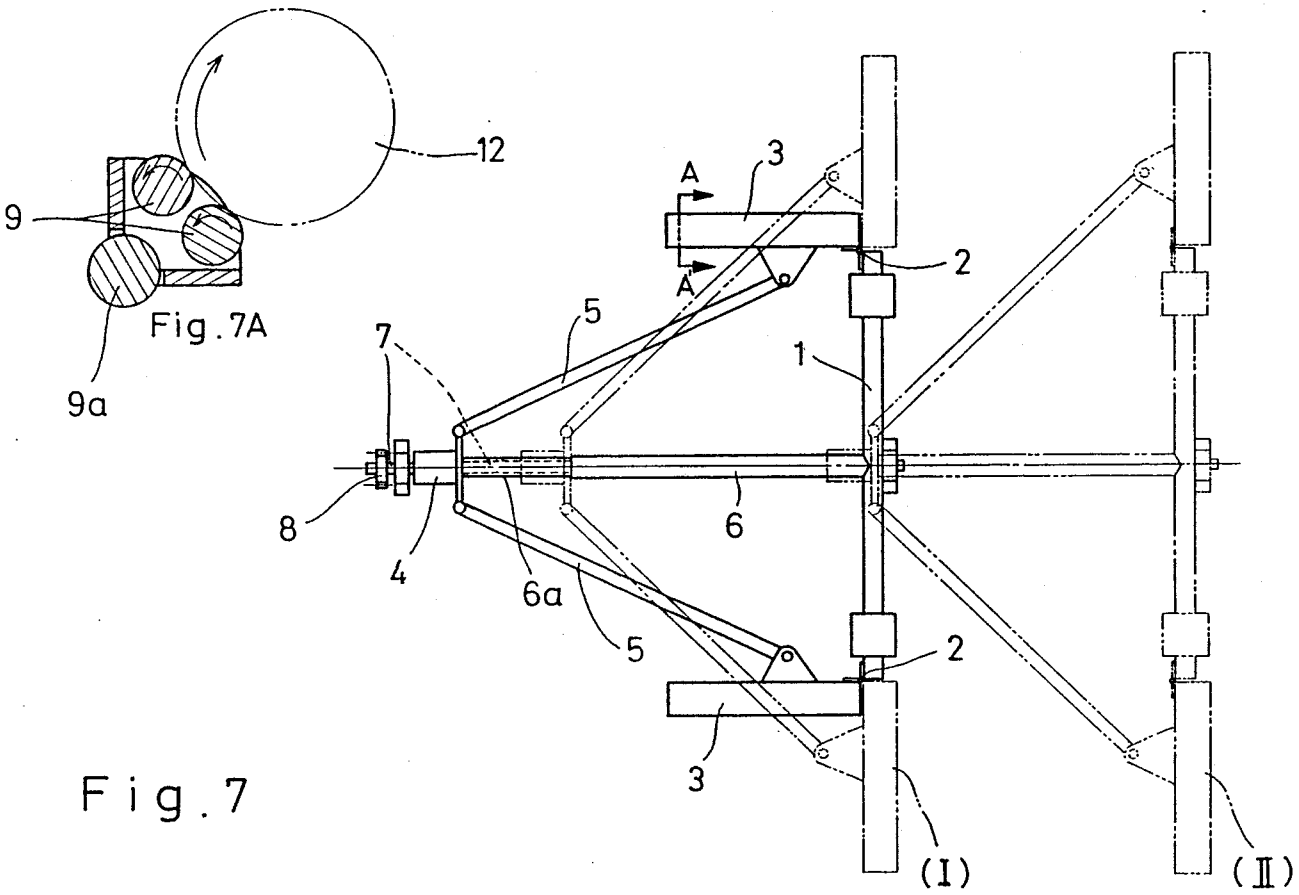
FIG. 7 is a plan view showing the wheel-pusher of the transporting means of the parking apparatus shown in FIG. 1.
FIG. 7A is a sectional view taken along line A—A' shown in FIG. 7.

The transporting means 105 further includes a pair of front and rear wheel-pushers **105*e* each of which, as shown in FIGS. 7 and 7A, includes a front rod 1, a pair of pushing elements 3 respectively hinged to the two ends of the front rod 1 by a pair of hinges 2, a nut 4, two connecting rods 5 respectively connected between the nut 4 and the pushing elements 3, an engaging pipe 6 perpendicular to the front rod 1, a guide rod 6a connected to the nut 4 and slidable in engaging pipe 6, a threaded shaft 7 engaging with nut 4, and a gear 8 secured to the shaft 7 so that when the gear 8 is driven, the nut 4 made irrotatable by the guide rod 6a will slide along the shaft 7. When the nut 4 is slid rightwards, the connecting rods 5 at the first stage urge the pushing elements 3 to reach the dotted positions (I). If the nut 4 is further slid rightwards, it will force the front rod 1, the pushing elements 3 and the engaging pipe 6 to reach the ultimate position (II). Each of the pushing element 3 includes a floor-contacting roller 9a assistantly supporting the respective pushing element 3 on the front rod 1, and two rotatable rollers 9** rotating in one direction when a car wheel W is pushed thereby to rotate in the opposite direction.

Figure 4:
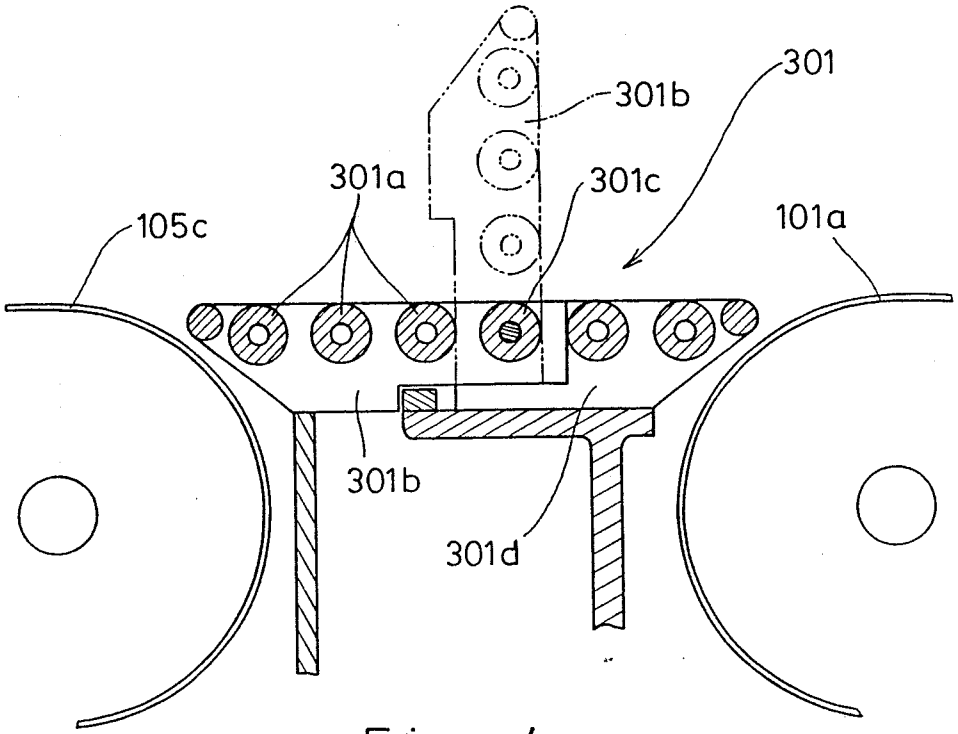
FIG. 4 is a sectional view showing a connector mounted, a transporting means and a parking position of the parking apparatus shown in FIG. 1.
Figures 5, 6:
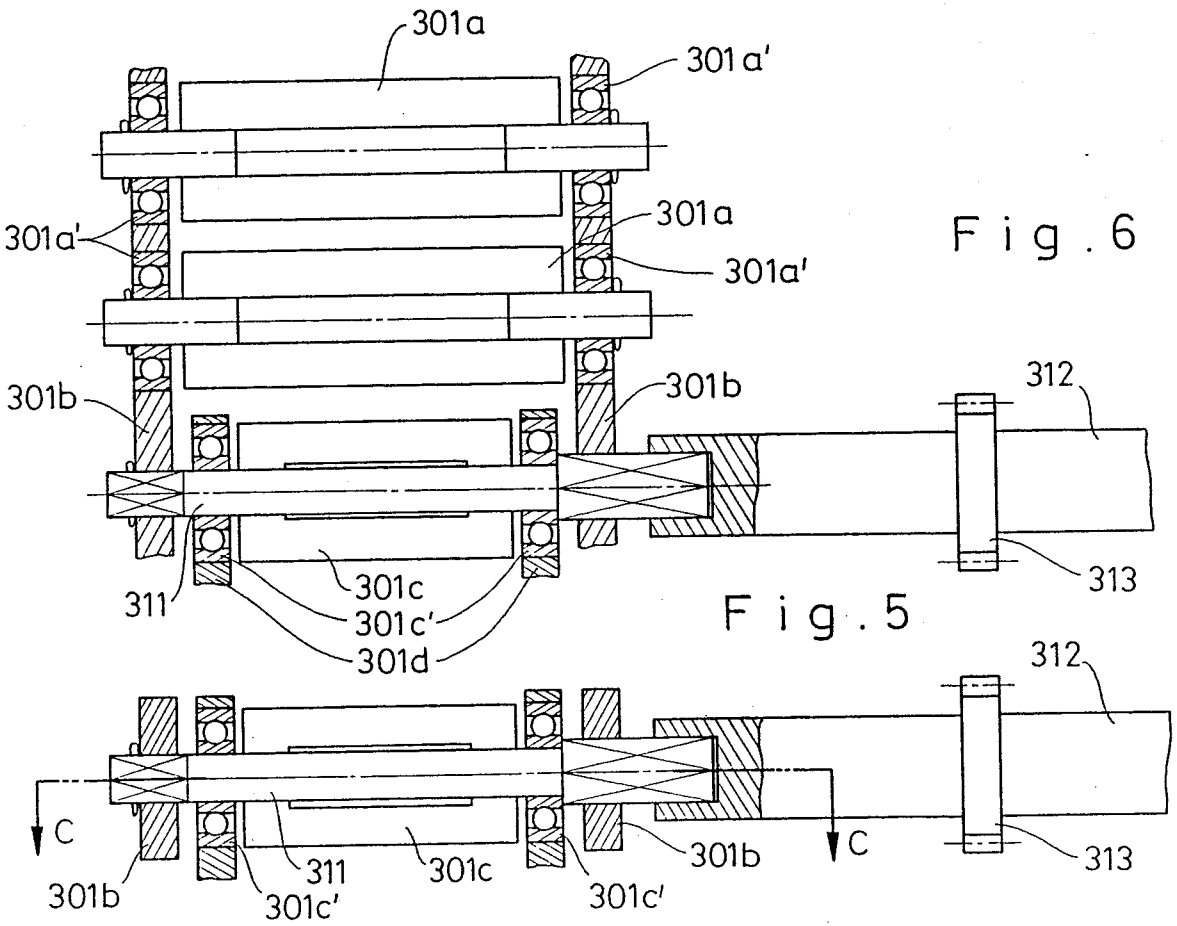
FIG. 5 is a structural view showing the pivoting portion of the connector shown in FIG. 4.
FIG. 6 is a sectional view taken along line C—C shown in FIG. 5.

Two pairs of connectors 301, 302 are respectively mounted between the transporting means 105 and the right and left parking positions 101, 103. Each connector 301, as shown in FIGS. 3–6, includes several rotatable rollers 301a flush with conveying belts 105c, 101a, a pair of pivotable side mounting plates 301b secured to a shaft 311 driven by a transmitting shaft 312, which fixes thereto a gear 313 driven by a motor to collapse the side plates 301b between a solid position and a dotted position, as shown in FIG. 4, and a pair of fixed side mounting plates 301d.

Figure 8:
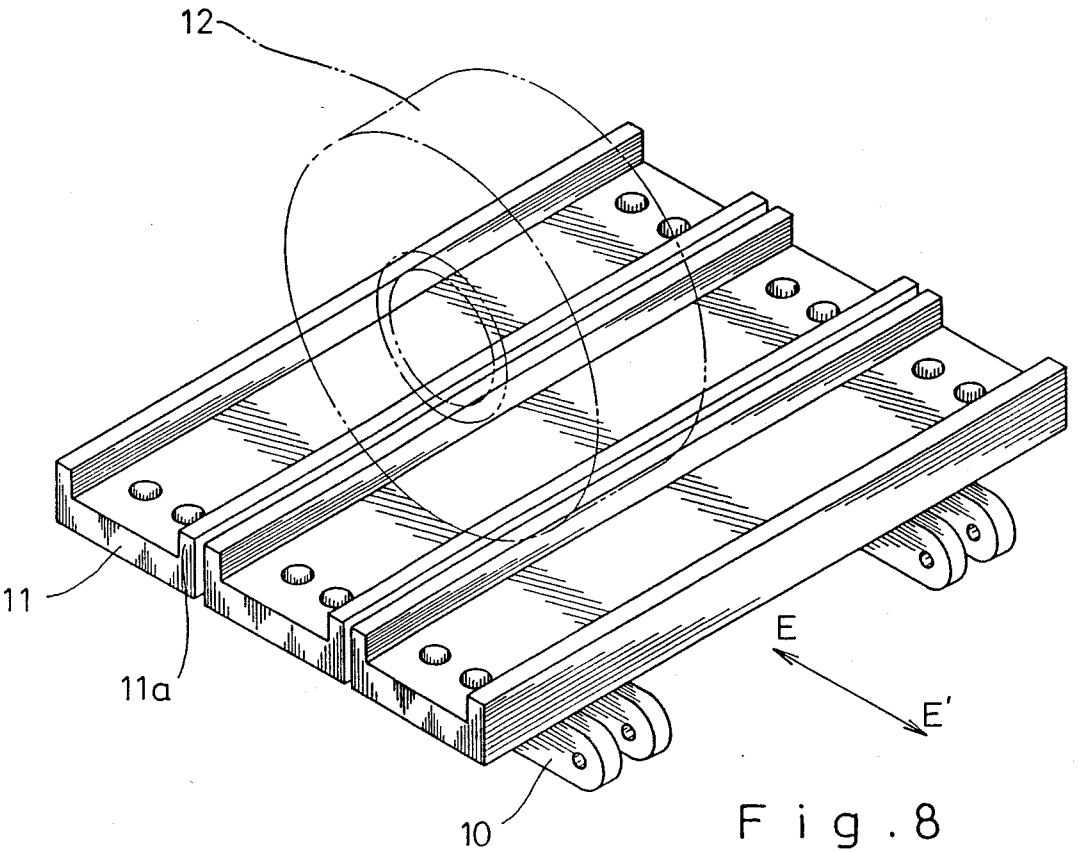
FIG. 8 is a perspective view showing a conveying belt used in the parking apparatus shown in FIG. 1 in the longitudinal direction of a car.

As shown in FIG. 8, each of the conveying belts 104a, 105a, 105b, 105d, 102a moving in the direction of arrow EE' includes two chains 10 mounting thereon a pluralily of longitudinally grooved plates 11 having longitudinal sides 11a capable of positively carrying a car wheel 12, but preventing said wheel from running easily thereon. Each of the conveying belts 101a, 105c, 103a moving in the direction perpendicular to the arrow EE' direction. Each of the conveying belts can also be made by chains 10 and plates 11 or by a flat belt of hard rubber material.

As it has been notoriously known in the relevant art, the present multi-storied parking apparatus can easily be computerized. A computerized operating procedure thereof will be described as follows with reference to FIG. 9.

Figure 9:
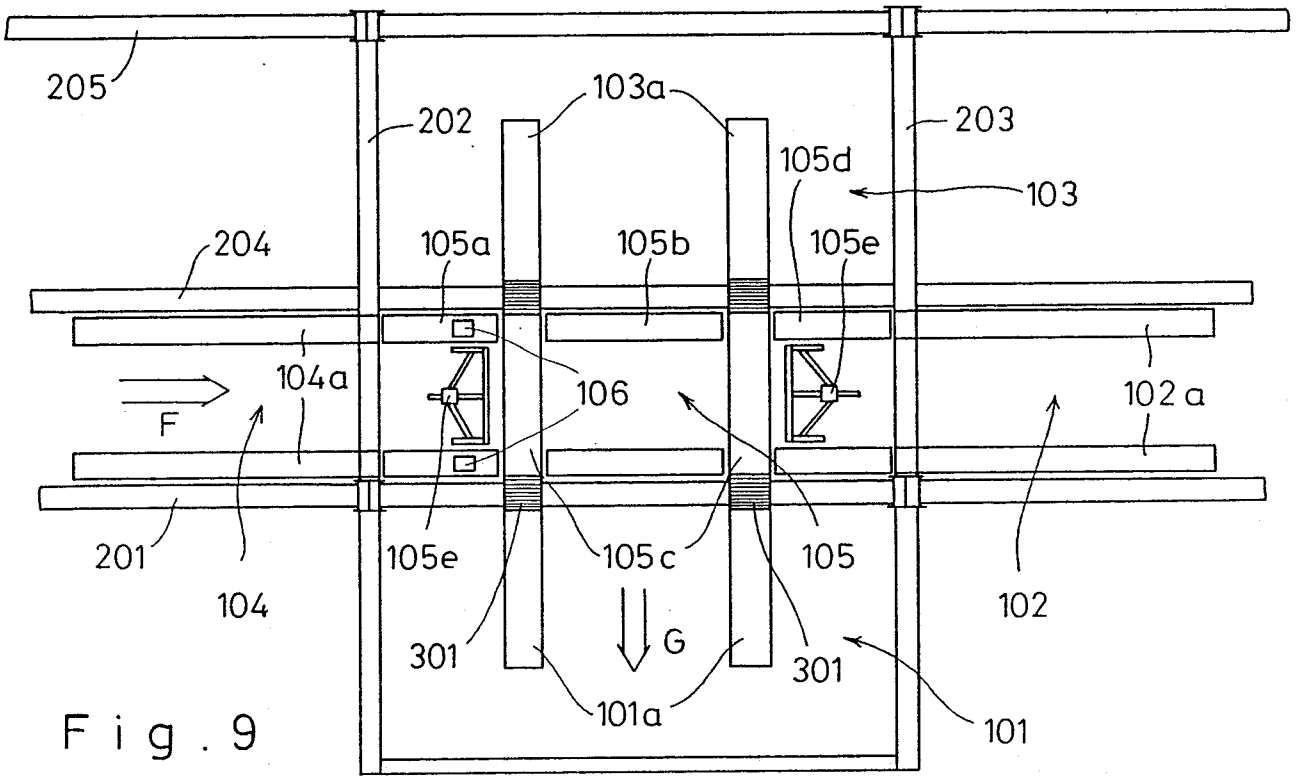
FIG. 9 is a simplified schematic view showing an integral parking unit of the parking apparatus shown in FIG. 1.

If it is desired to park a car in the present parking apparatus, the person in charge first selects an unoccupied parking position from the display and lowers the respective transporting means 105 to the ground floor. Assuming parking position 101 is selected, the car is driven along the direction of arrow F into the respective transporting means 105 with the hand-brake released. A measuring device 106 includes a sensor generating a first signal when the rear wheel has reached a predetermined point on the conveying belt 105a. When the rear pair of wheels of the car press upon the measuring device 106, a micro-processor generates a second signal in response to the first signal, and an infrared detector detects the position of the front wheel in response to the second signal, the micro-processor (not shown) will then calculate the distance between the front and rear wheels and the pair of wheel-pushers 105e will be instructed to move toward each other in accordance with the calculated wheel distance in order that the wheel-pushers 105e will centrally position therebetween the four wheels of the car on the conveying belts 105c in a perfect manner no matter what the magnitude of the calculated wheel distance is. Thus, when the transporting means 105 is elevated, the car will not randomly run thereon even on the event of an earthquake. After the transporting means 105 has reached the desired story of the parking building, the wheel-pushers 105e are retracted to the original positions, which positions are shown in FIG. 9, and connectors 301 are operated to be flush with the conveying belts 105c, 101a. Then, the conveying belts 105c, 101a are driven at the same speed to run in the direction of arrow G to carry the car from the transporting means 105 through connectors 301 into the parking position 101. Thereafter, the side plates 301b are driven to be vertical in order to guard the car in the parking position 101. A similar computerized procedure can be followed if another parking position 103 is selected.

If another parking position 102 is selected, the right wheel-pusher 105e will be retracted to the original position after the transporting means 105 has reached the desired story and the pushing elements 3 of the left wheel-pusher 105e will push the rear pair of wheels of the car from the left conveying belt 105c to the conveying belts 105b. Then, the conveying belts 105b, 105d, 102a are driven to run in the direction of arrow F in order to convey the car from transporting means 105 to the selected parking position 102. Thereafter, the left wheel-pusher 105e is retreated to the original position and the car wheels can be stopped by a pair of stoppers (not shown) in the selected parking position 102. A similar computerized procedure can be followed if parking position 104 is selected.

If the owner wishes to retrieve his car, the respective computerized procedure described above will be executed in a reverse order. The advantages achieved by the present multi-storied parking apparatus can be summarized as follows:

(1) Theoretically, the present invention can be embodied by a multi-storied building having at each of its stories a transporting means 105 and any one of parking positions 101–104 so that it can be constructed at virtoally any location regardless of available space.

(2) It only requires a relatively short time for the transporting means 105 to park or retrieve a car to or from its parking position.

(3) Concerning construction, the present invention needs only a small amount of foundation work, since it can be easily constructed with cement or steel piles, shaped steels, floor plates and partitioning walls.

(4) The apparatus can park any car, regardless its wheel distance, without the possibility of the car or any article in it being stolen.

(5) Outside hours of operation of the parking building, the ground floor can be put to other use, such as car maintenance.

While the present invention has been described in connection with a preferred embodiment, numerous modifications can be easily made thereto by those skilled in the art without departing from the spirit and scope of the present invention which is defined in the appended claims.

What I claim is:

1. A vehicle parking apparatus comprising:

a multi-storied building having at least one parking position on each of its stories;

at least one transporting means for moving a vehicle, said transporting means comprising:

a means for vertically moving said vehicle to any of said stories, said vertical moving means comprising:

a central portion; and four primary sides, each of said primary sides being capable of adjoining one of said parking positions, said four primary sides being a front, a rear, a left and a right side with respect to a car positioned in said central portion;

a means for conveying said car between each of said central portions and said parking positions adjoining any one of said four primary sides comprising:

four pairs of reversible conveying belts located on said central portions being positioned such that one pair of said belts extends in parallel from right to left side, with three sets of additional parallel pairs extending from front to rear and intersecting said one pair of said belts; and a pair of parallel extending reversible conveying belts located on each of said parking positions and being operably aligned with said belts positioned on said central portion, said belts being capable of combining to carry four wheels of said car;

a connector mounted between said right and left sides and the respective adjoining parking position such that said conveying means is capable of smoothly conveying the car between said central portions and said respective parking positions; and a pair of front and rear wheel-pushers provided for urging said car to move toward said front and rear primary sides and being positioned on said control portion so as to be on opposite sides of said car.

2. A multi-storied parking apparatus according to claim 1, wherein said vertical moving means comprises an elevator.

3. A multi-storied parking apparatus as in claim 1, wherein said reversible conveying belts are comprised of at least one chain and a plurality of longitudinally grooved plates.

4. A multi-storied parking apparatus as in claim 1, wherein said reversible conveying belts are comprised of an endless flat belt of hard rubber material.

5. A multi-storied parking apparatus according to claim 1, wherein each of said wheel pushers comprises:

a front rod including two ends;

a pushing element pivotally connected on each of said front rod ends;

a nut;

two connecting rods each having a first end pivotally connected to said nut and each having a second end pivotally connected to such pushing elements;

an engaging pipe positioned perpendicular and secured to said front rod;

a guide rod connected to said nut and slidably mounted on said engaging pipe; and a threaded shaft engaging with said nut and securing thereto a gear so that when said gear is driven, said nut will slide along said threaded shaft and cause said wheel-pushers to pivot about said front rod pivotal connection for engagement with said car wheels.

6. A multi-storied parking apparatus according to claim 1, wherein said connector is collapsible such that the operation of the vertical moving means is not interfered with.

7. A multi-storied parking apparatus according to claim 1, wherein said front and rear wheel pushers further include:

a sensor generating a first signal when one wheel of said car has reached a predetermined position on said vertical moving means;

a micro-processor electrically connected to said sensor, receiving said first signal and generating a second signal in response;

an infrared detector electrically connected to said microprocessor, receiving said second signal and detecting a position of a corresponding distant wheel of said car and generating a third signal, said microprocessor receiving said third signal being capable of calculating the distance between a front pair and a rear pair of wheels of said car, and generates an output command to said pair of wheel pushers to move towards each other in accordance with said calculated wheel distance.

8. A method of parking a car in a multi-storied parking apparatus with both a means for vertically moving and for conveying a car from the vertical movement means to a parking position located at a front or rear side relative to the car comprising the steps of:

moving a car onto a central portion of a means for vertically moving said car;

detecting when a rear wheel of said car has reached a predetermined position on said central portion;

detecting a front wheel location at the instant that said rear wheel reaches said predetermined position;

calculating a distance between said front and rear wheels;

commanding a front wheels-pusher and a rear wheels-pusher to move towards each other into engagement with said front and rear wheels, said wheels-pushers being positioned on said central position so as to be on opposite sides of said car;

positioning said front and rear wheels on a pair of transversely extending conveyer belts in accordance with said calculated wheel distance;

maintaining engagement of said wheels-pushers with said front and rear wheel such that said car will not run randomly on said conveyor belts;

moving said car vertically to a desired story;

retracting said wheels-pusher positioned on said side of car most adjacent a selected parking position;

extending said wheels-pusher positioned on said side of car not adjacent said selected parking position such that said front and rear wheels are pushed off of said transversely extending conveyor belts and onto two pairs of conveyor belts extending longitudinally along said central portion;

conveying said car to said selected parking position by operating said two pairs of longitudinally extending conveyor belts synchronously with a pair of conveyor belts positioned on said selected parking portion.

9. A method of parking a car in a multi-storied parking apparatus with both a means for vertically moving and for conveying a car from said vertical movement means to a parking position located at a left or right side relative to said car comprising the steps of:

moving a car onto a central portion of a means for vertically moving said car;

detecting when a rear wheel of said car has reached a predetermined position on said central portion;

detecting a front wheel location at the instant that said rear wheel reaches said predetermined position;

calculating a distance between said front and rear wheels;

commanding a front wheels-pusher and a rear wheels-pusher to move towards each other into engagement with said front and rear wheels, said wheels-pushers being positioned on said central portion so as to be on opposite sides of said car;

positioning front and rear wheels on a pair of transversely extending conveyer belts in accordance with said calculated wheel distance;

maintaining engagement of said wheels-pushers with said front and rear wheels such that said car will not run randomly on said conveyor belts;

moving said car vertically to a desired story;

retracting both of said wheels-pushers;

conveying said car to said selected parking position by operating said transversely extending conveyor belts synchronously with a pair of conveyor belts positioned on said selected parking position.

* * * * *